US008703046B2

(12) United States Patent
Hanejko

(10) Patent No.: US 8,703,046 B2
(45) Date of Patent: Apr. 22, 2014

(54) METHODS FOR PREPARING METALLURGICAL POWDER COMPOSITIONS AND COMPACTED ARTICLES MADE FROM THE SAME

(75) Inventor: Francis G. Hanejko, Marlton, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 0 days.

(21) Appl. No.: 13/334,622

(22) Filed: Dec. 22, 2011

(65) Prior Publication Data

US 2012/0219451 A1 Aug. 30, 2012

Related U.S. Application Data

(63) Continuation of application No. 11/504,847, filed on Aug. 15, 2006, now abandoned.

(60) Provisional application No. 60/758,354, filed on Jan. 12, 2006.

(51) Int. Cl.
*B22F 1/00* (2006.01)

(52) U.S. Cl.
USPC ..... 419/62; 419/64

(58) Field of Classification Search
None
See application file for complete search history.

(56) References Cited

U.S. PATENT DOCUMENTS

| | | | | |
|---|---|---|---|---|
| 2,783,208 | A | | 2/1957 | Katz |
| 4,106,932 | A | | 8/1978 | Blachford |
| 4,384,800 | A | | 5/1983 | Dyama |
| 4,483,905 | A | | 11/1984 | Engström |
| 5,063,011 | A | | 11/1991 | Rutz et al. |
| 5,069,714 | A | | 12/1991 | Gosselin |
| 5,108,493 | A | * | 4/1992 | Causton ..... 75/255 |
| 5,154,881 | A | | 10/1992 | Rutz et al. |
| 5,268,140 | A | | 12/1993 | Rutz et al. |
| 5,290,055 | A | | 3/1994 | Treat, Jr. |
| 5,330,792 | A | | 7/1994 | Johnson et al. |
| 5,368,630 | A | | 11/1994 | Luk |
| 5,429,792 | A | | 7/1995 | Luk |
| 5,498,276 | A | | 3/1996 | Luk |
| 5,798,177 | A | | 8/1998 | Jansson |
| 6,039,784 | A | | 3/2000 | Luk |
| 6,372,348 | B1 | | 4/2002 | Hanejko et al. |
| 6,534,564 | B2 | | 3/2003 | Hanejko et al. |
| 6,635,122 | B2 | | 10/2003 | Hanejko et al. |
| 2002/0037948 | A1 | | 3/2002 | Hanejko et al. |

(Continued)

FOREIGN PATENT DOCUMENTS

| | | |
|---|---|---|
| CA | 2351487 | 6/2000 |
| JP | H02-170901 | 7/1990 |

(Continued)

*Primary Examiner* — Yoshitoshi Takeuchi
(74) *Attorney, Agent, or Firm* — Baker & Hostetler LLP

(57) ABSTRACT

Provided are methods of preparing high density compacted components that increase that lubricity of metallurgical powder compositions while reducing the overall organic content of the compacted component. Method of preparing high density compacted components having a high density include the steps of providing a metallurgical powder composition having particles at least partially coated with a metal phosphate layer, and compacting the metallurgical powder composition in the die at a pressure of at least about 5 tsi. The metallurgical powder composition comprises a base-metal powder, optional alloying powders, and a particulate internal lubricant. The metal phosphate at least partially coats the base-metal powder, the optional alloying powder, or both. The metal phosphate coating increases the lubricity of metallurgical powders without the need for large quantities of organic material, e.g., lubricants and binders.

8 Claims, 3 Drawing Sheets

(56) References Cited

U.S. PATENT DOCUMENTS

| | | | | |
|---|---|---|---|---|
| 2002/0040077 | A1* | 4/2002 | Hanejko et al. | 523/451 |
| 2003/0127157 | A1 | 7/2003 | Iyoda et al. | |
| 2004/0081574 | A1 | 4/2004 | Poszmik et al. | |

FOREIGN PATENT DOCUMENTS

| | | | |
|---|---|---|---|
| JP | 1992-021702 | | 1/1992 |
| JP | 2008-550427 | | 1/1992 |
| JP | 2005-113258 | | 4/2005 |
| JP | 2005-154863 | | 6/2005 |
| JP | 2005-281805 | | 10/2005 |
| WO | WO 96/02345 | A1 | 2/1996 |
| WO | WO 99/11406 | | 3/1999 |
| WO | WO 99/20689 | | 4/1999 |
| WO | WO 00/30835 | | 6/2000 |
| WO | WO 2004/191619 | | 9/2004 |

* cited by examiner

METHODS FOR PREPARING METALLURGICAL POWDER COMPOSITIONS AND COMPACTED ARTICLES MADE FROM THE SAME

CROSS REFERENCE TO RELATED APPLICATIONS

This application is a continuation of U.S. application Ser. No. 11/504,847, filed Aug. 15, 2006, which claims priority to U.S. Application No. 60/758,354, filed Jan. 12, 2006, the entire disclosure of which is incorporated herein by reference.

FIELD OF THE INVENTION

The present invention relates to methods of making compacted powder metallurgical components and powder metallurgical components made from such methods. More particularly, the present invention is directed to methods of reducing the organic content of high density compacted powder metallurgical components and powder metallurgical components made from such methods.

BACKGROUND OF THE INVENTION

Iron-based particles have long been used as a base material in the manufacture of structural components by powder metallurgical methods. The iron-based particles are first molded in a die under high pressures in order to produce a desired shape. After the molding step, the structural component may undergo a sintering step to impart additional strength.

Research in the powder metallurgical manufacture of compacted components using iron-based powders has been directed to the development of iron powder compositions that enhance certain physical and magnetic properties without detrimentally affecting other properties. Desired properties that often must be balanced include, for example, high density and strength, and ease of removing a part from a compacting die. Desirable properties for magnetic parts include, for example, a high permeability through an extended frequency range, high pressed strength, low core losses, and suitability for compression molding techniques.

Compaction of powder metallurgical compositions is carried out within a die cavity that is subjected to extreme pressures. To avoid excessive wear on the die cavity, lubricants are commonly used during the compaction process. However, most known lubricants detrimentally affect the physical properties of compact parts. For example, use of lubricants often reduces the green strength of green compacts. It is believed that during compaction an internal lubricant is exuded between iron and/or alloying metal particles such that it fills the pore volume between the particles and interferes with particle-to-particle bonding. Indeed, some shapes cannot be pressed using known internal lubricants. Tall, thin-walled bushings, for example, require large amounts of internal lubricant to overcome die wall friction and reduce the required ejection force. Such levels of internal lubricant, however, typically reduce green strength to the point that the resulting compacts crumble upon ejection. Also, internal lubricants often adversely affect powder flow rate and apparent density, as well as green density of the compact, particularly at higher compaction pressures. Moreover, excessive amounts of internal lubricants can lead to compacts having poor dimensional integrity, and volatized lubricant can form soot on heating surfaces of the sintering furnace.

To avoid problems associated with internal lubricants, it is known to use an external spray lubricant rather than an internal lubricant. However, use of external lubricants increases compaction cycle time and leads to less uniform compaction. It is readily known to those skilled in the art that the inherent variability of using an external lubricant limits the commercial usefulness of such fabrication techniques. These limitations are especially prevalent in techniques for fabricating high density parts.

Accordingly, there exists a need in the art for methods of preparing high density compacted components that are easily ejected from die cavities.

SUMMARY OF THE INVENTION

Provided are methods of preparing high density compacted components that increase the lubricity of metallurgical powder compositions while reducing the overall organic content of the compacted component. Methods of preparing high density compacted components include the steps of providing a metallurgical powder composition having base metal particles at least partially coated with a metal phosphate layer, and compacting the metallurgical powder composition in a die at a pressure of at least about 5 tsi.

The metallurgical powder composition comprises a base-metal powder, optional alloying powders, and a particulate internal lubricant. The metal phosphate at least partially coats the base-metal powder, the optional alloying powder, or both. The metal phosphate coating increases the lubricity of metallurgical powders without the need for large quantities of organic material, e.g., lubricants and binders. Without being limited by theory, it is believed that the metal phosphate coating traps lubricant particles on the surface of metal particles and compacted parts and thereby increases lubricity. The present methods are especially useful in drawing operations and when compaction temperatures exceed room temperature.

Metal phosphates include for example, manganese phosphate, zinc phosphate, nickel phosphate, copper phosphate, and combinations thereof. Particulate internal lubricants include, for example, polyamides, $C_5$ to $C_{30}$ fatty acids, metal salts of polyamides, metal salts of $C_5$ to $C_{30}$ fatty acids, ammonium salts of $C_5$ to $C_{30}$ fatty acids, lithium stearate, zinc stearate, manganese stearate, calcium stearate, ethylene bis-stearamide, polyethylene waxes, polyolefins, and combinations thereof.

In one embodiment, metallurgical powder compositions include less than about 0.5 weight percent of a particulate internal lubricant and provide sintered compacted components having a density of at least about 7.4 g/cm$^3$.

In another embodiment, metallurgical powder compositions are composed of a base metal powder bonded with a particulate internal lubricant containing an amide lubricant. The metallurgical powder composition is composed of 0.40 weight percent total organic materials, such as for example, 0.10 weight percent binding agent, about 0.15 weight percent of a polyamide lubricant composed of ethylene bis-stearamides having an initial melting point between about 200° C. and 300° C., and about 0.15 weight percent of polyamide lubricant composed of an admixture of ethylene bisstearamide and zinc stearate.

DETAILED DESCRIPTION OF ILLUSTRATIVE EMBODIMENTS

Figure 1:
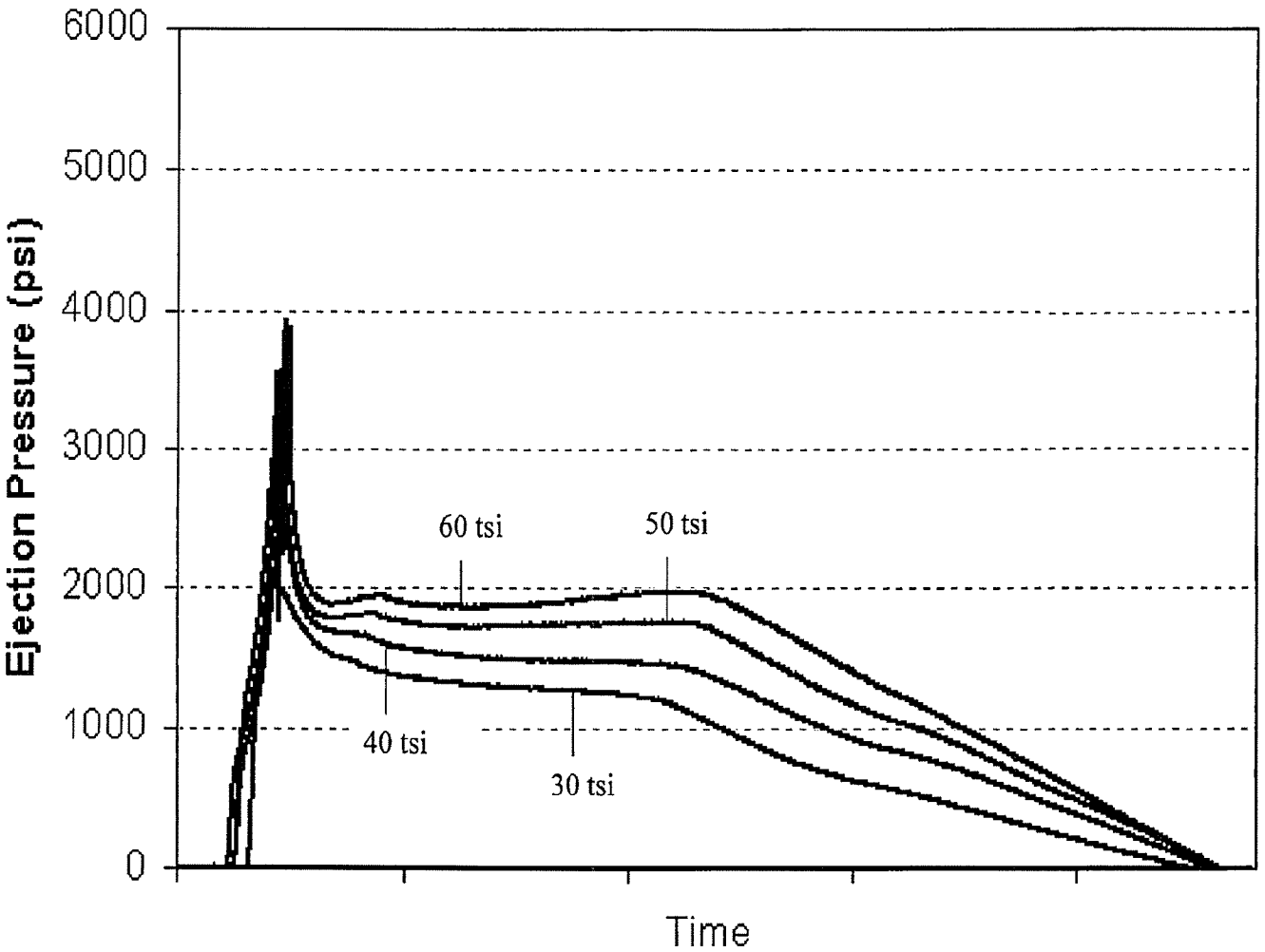
FIG. 1 is a graph of ejection pressure verses time for compacts prepared from an exemplary metallurgical powder composition when compressed at four different compaction pressures.

Described are methods of preparing high density compacted components and compacted components made therefrom. Methods of preparing high density compacted components include the steps of providing a metallurgical powder composition having particles at least partially coated with a metal phosphate layer, and compacting the metallurgical powder composition in a die. The metallurgical powder composition comprises a base-metal powder, optional alloying powders, and a particulate internal lubricant. The metal phosphate at least partially coats the base-metal powder, the optional alloying powder, or both. The described methods provide high density compacted components that increase the lubricity of metallurgical powder compositions while reducing the overall organic lubricant content of compacted parts.

Base-metal powders are any base-metal powder, or a blend of more than one powder, of the kind generally used in the powder metallurgy industry. Base-metal powders include, for example, iron-based powders and nickel based powders. Preferably, the base-metal powder is an iron-based powder.

Examples of "iron-based" powders, as that term is used herein, are powders of substantially pure iron, powders of iron pre-alloyed with other elements (for example, steel-producing elements) that enhance the strength, hardenability, electromagnetic properties, or other desirable properties of the final product, and powders of iron to which such other elements have been diffusion bonded. The iron based powder can be a mix of an atomized iron powder and a sponge iron, or other type of iron powder.

Substantially pure iron powders are powders of iron containing not more than about 1.0% by weight, preferably no more than about 0.5% by weight, of normal impurities. These substantially pure iron powders are preferably atomized powders prepared by atomization techniques. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85-3.00 g/cm$^3$, typically 2.94 g/cm$^3$. Other substantially pure iron powders that can be used in the invention are typical sponge iron powders, such as Hoeganaes' ANCOR® MH-100 powder.

The iron-based powder can incorporate one or more alloying elements that enhance the mechanical or other properties of the final metal part. Such iron-based powders can be powders of iron, preferably substantially pure iron, that has been blended or pre-alloyed with one or more such elements. Iron based powders also include combinations of blended and prealloyed powders. Pre-alloyed iron based powders are prepared by making a melt of iron and the desired alloying elements, and then atomizing the melt, whereby the atomized droplets form the powder upon solidification.

Examples of alloying elements that can be blended or pre-alloyed with iron based powders include, but are not limited to, molybdenum, manganese, magnesium, chromium, silicon, copper, nickel, gold, vanadium, columbium (niobium), graphite, phosphorus, aluminum, and combinations thereof. Preferred alloying elements are molybdenum, phosphorus, nickel, silicon, and combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders, e.g., ANCORSTEEL 50HP, 85HP, and 150HP, ANCORSTEEL 737, ANCORSTEEL 2000, ANCORSTEEL 4300, and ANCORSTEEL 4600V, FD4600, and FD4600A.

Alloying powders that can be admixed with base-metal powders are those known in the metallurgical powder field to enhance the strength, hardenability, electromagnetic properties, or other desirable properties of the final sintered product. Steel-producing elements are among the best known of these materials. Exemplary alloying materials are binary alloys of copper with tin or phosphorus; ferro-alloys of iron with manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum. These alloying powders are in the form of particles that are generally of finer size than the particles of metal powder with which they are admixed.

The alloying powders generally have a particle size distribution such that they have a $d_{90}$ value of below about 100 microns, preferably below about 75 microns, and more preferably below about 50 microns; and a $d_{50}$ value of below about 75 microns, preferably below about 50 microns, and more preferably below about 30 microns. The amount of alloying powder present in the composition will depend on the properties desired of the final sintered part. Generally the amount will be minor, up to about 5% by weight of the total powder composition weight, although as much as 10-15% by weight can be present for certain specialized powders. A preferred range suitable for most applications is about 0.25-4.0% by weight. Particularly preferred alloying elements for use in the present invention for certain applications are copper and nickel, which can be used individually at levels of about 0.25-4% by weight, and can also be used in combination.

An exemplary iron-based powder is a substantially pure iron pre-alloyed with molybdenum (Mo). The powder is produced by atomizing a melt of substantially pure iron containing from about 0.5 to about 2.5 weight percent Mo. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeganaes' ANCORSTEEL 4600V steel powder, which contains about 0.5-0.6 or 0.4-0.6 weight percent molybdenum, about 1.5-2.0 weight percent nickel, and about 0.1-0.25 weight percent manganese, and less than about 0.02 weight percent carbon.

Another exemplary pre-alloyed iron-based powder is disclosed in U.S. Pat. No. 5,108,493, which is herein incorporated by reference in its entirety. This steel powder composition is an admixture of two different pre-alloyed iron-based powders, one being a pre-alloy of iron with 0.5-2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

A further example of iron-based powders are diffusion-bonded iron-based powders which are particles of substantially pure iron that have a layer or coating of one or more other alloying elements or metals, such as steel-producing elements, diffused into their outer surfaces. A typical process for making such powders is to atomize a melt of iron and then combine this atomized powder with the alloying powders and anneal this powder mixture in a furnace. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

Whether in a particulate, pre-alloyed, or diffusion-bonded iron-based powder, the alloying elements are present in an amount that depends on the properties desired of the final sintered part. Generally, the amount of the alloying elements will be relatively minor, up to about 5% by weight of the total powder composition weight, although as much as 10-15% by weight can be used in certain applications. A preferred range is typically between 0.25 and 4% by weight.

Other iron-based powders that are useful in the practice of the invention are ferromagnetic powders. An example is a powder of iron pre-alloyed with small amounts of phosphorus.

The iron-based powders that are useful in the practice of the invention also include stainless steel powders. These stainless steel powders are commercially available in various grades in the Hoeganaes ANCOR® series, such as the ANCOR® 303L, 304L, 316L, 410L, 430L, 434L, and 409Cb powders. Also, iron-based powders include tool steels made by the powder metallurgy method.

Particles of iron-based powders, such as for example substantially pure iron powders, diffusion bonded iron powders, and pre-alloyed iron powders, have a distribution of particle sizes. Typically, these powders are such that at least about 90% by weight of the powder sample can pass through a No. 45 sieve (U.S. series), and more preferably at least about 90% by weight of the powder sample can pass through a No. 60 sieve. These powders typically have at least about 50% by weight of the powder passing through a No. 70 sieve and retained above or larger than a No. 400 sieve, more preferably at least about 50% by weight of the powder passing through a No. 70 sieve and retained above or larger than a No. 325 sieve. Also, these powders typically have at least about 5 weight percent, more commonly at least about 10 weight percent, and generally at least about 15 weight percent of the particles passing through a No. 325 sieve.

As such, these powders can have a weight average particle size as small as one micron or below, or up to about 850-1,000 microns, but generally the particles will have a weight average particle size in the range of about 10-500 microns. Preferred are iron or pre-alloyed iron particles having a maximum weight average particle size up to about 350 microns; more preferably the particles will have a weight average particle size in the range of about 25-150 microns, and most preferably 80-150 microns. Reference is made to MPIF Standard 05 for sieve analysis.

Base-metal powders can also include nickel-based powders. Examples of "nickel-based" powders, as that term is used herein, are powders of substantially pure nickel, and powders of nickel pre-alloyed with other elements that enhance the strength, hardenability, electromagnetic properties, or other desirable properties of the final product. The nickel-based powders can be admixed with any of the alloying powders mentioned previously with respect to the iron-based powders. Examples of nickel-based powders include those commercially available as the Hoeganaes ANCOR-SPRAY® powders such as the N-70/30 Cu, N-80/20, and N-20 powders. These powders have particle size distributions similar to the iron-based powders. Preferred nickel-based powders are those made by an atomization process.

The described iron-based powders that constitute the base-metal powder, or at least a major amount thereof, are, as noted above, preferably atomized powders. These iron-based powders have apparent densities of at least 2.75, preferably between 2.75 and 4.6, more preferably between 2.8 and 4.0, and in some cases more preferably between 2.8 and 3.5 $g/cm^3$.

Base metal powders constitute a major portion of the metallurgical powder composition, and generally constitute at least about 85 weight percent, preferably at least about 90 weight percent, and more preferably at least about 95 weight percent of the metallurgical powder composition.

A metal phosphate coating substantially, completely, or at least partially covers the base metal powders, optional alloying powders, or both. Metal phosphates include any metal phosphate known to those skilled in the art. Metal phosphates include, for example, manganese phosphate, nickel phosphate, zinc phosphate, copper phosphate, and combinations thereof. Preferably, the metal phosphate is zinc phosphate.

The metal phosphate coating increases the lubricity of metallurgical powders without the need for high lubricant content, i.e., organic content. Without being limited by theory it is believed that the metal phosphate coating traps lubricant particles on the surface of metal particles and compacted parts. The present methods are especially useful in drawing operations and when compaction temperature exceed room temperature.

Thus, metallurgical powder composition may be prepared that exhibit higher pore free density and lower total organic content compared to compositions that do not include a metal phosphate coating. Lowering the total organic content of metallurgical powder compositions is beneficial in that less organic material must be removed during sintering. Further, metallurgical powder compositions containing a metal phosphate coating exhibited higher compressibility and green strength at compression temperatures greater than 120° F. For example, metallurgical powder compositions exhibited green strength more than 100% compared to compositions that did not include a metal phosphate coating.

Metallurgical powder compositions include from about 0.01 to about 1 weight percent of metal phosphate. Preferably, metallurgical powder compositions include from about 0.05 to about 0.40 weight percent of the metal phosphate. More preferably, metallurgical powder compositions include from about 0.05 to about 0.20 weight percent of the metal phosphate.

Metallurgical powder compositions include particulate internal lubricants. Particulate internal lubricants include internal lubricants that are commonly known to those skilled in the art. Particulate internal lubricants reduce the ejection forces required to remove the compacted component form the compaction die cavity. Examples of particulate internal lubricants include stearate compounds, such as lithium, zinc, manganese, and calcium stearates, waxes such as ethylene bis-stearamides, polyethylene wax, polyolefins, amide lubricants, and mixtures of these types of lubricants. Other lubricants include those containing a polyether compound such as is described in U.S. Pat. No. 5,498,276 to Luk, and those useful at higher compaction temperatures described in U.S. Pat. No. 5,368,630 to Luk & U.S. Pat. No. 5,154,881 to Rutz, in addition to those disclosed in U.S. Pat. No. 5,330,792 to Johnson et al., each of which is incorporated herein in its entirety by reference.

Although lithium stearate is utilized as a lubricant, some embodiments require limited quantities, or exclusion of lithium stearate. Without being limited by theory it is believed that lithium stearate reacts with phosphoric acid to form a stearic acid having a lower melting temperature compared to the lithium stearate. This reaction may result in lower lubricity.

Amide lubricants, such as those disclose in U.S. Pat. No. 5,368,630 to Luk, are, in essence, high melting-point waxes. Preferably, the amide lubricants are the condensation product of a dicarboxylic acid, a monocarboxylic acid, and a diamine.

Dicarboxylic acids are linear acids having the general formula HOOC(R)COOH where R is a saturated or unsaturated linear aliphatic chain of 4-10, preferably about 6-8, carbon atoms. Preferably, the dicarboxylic acid is a $C_8$-$C_{10}$ saturated acid. More preferably, the dicarboxylic acid is sebacic acid. The dicarboxylic acid is present in an amount of from about 10 to about 30 weight percent of the starting reactant materials.

Monocarboxylic acids are saturated or unsaturated $C_{10}$-$C_{22}$ fatty acids. Preferably, the monocarboxylic acid is a $C_{12}$-$C_{20}$ saturated acid. More preferably, the monocarboxylic acid is stearic acid. A preferred unsaturated monocarboxylic acid is oleic acid. The monocarboxylic acid is present in an amount of from about 10 to about 30 weight percent of the starting reactant materials.

Diamines are alkylene diamines, preferably of the general formula $(CH_2)_X(NH_2)_2$ where x is an integer of about 2-6. More preferably the diamine is ethylene diamine Diamines are present in an amount of from about 40 to about 80 weight percent of the starting reactant materials to form the amide product.

The condensation reaction is preferably conducted at a temperature of from about 260° C. to about 280° C. and at a pressure up to about 7 atmospheres. The reaction is preferably conducted in a liquid state. Under reaction conditions at which diamines are in a liquid state, the reaction can be performed in an excess of the diamine acting as a reactive solvent. When the reaction is conducted at the preferred elevated temperatures as described above, even the higher molecular weight diamines will generally be in liquid state. A solvent such as toluene, or p-xylene can be incorporated into the reaction mixture, but the solvent must be removed after the reaction is completed, which can be accomplished by distillation or simple vacuum removal. The reaction is preferably conducted under an inert atmosphere such as nitrogen and in the presence of a catalyst such as 0.1 weight percent methyl acetate and 0.001 weight percent zinc powder. The reaction is allowed to proceed to completion, usually not longer than about 6 hours.

The lubricants formed by condensation reactions are a mixture of amides characterized as having a melting range rather than a melting point. As those skilled in the art will recognize, the reaction product is generally a mixture of moieties whose molecular weights, and therefore properties dependent on such, will vary. The reaction product can generally be characterized as a mixture of diamides, monoamides, bisamides, and polyamides. The preferred amide product has at least about 50%, more preferably at least about 65%, and most preferably at least about 75%, by weight diamide compounds. The preferred amide product mixture contains primarily saturated diamides having from 6 to 10 carbon atoms and a corresponding weight average molecular weight range of from 144 to 200. A preferred diamide product is N,N'-bis{2-[(1-oxooctadecyl)amino]ethyl}diamide.

The reaction product, containing a mixture of amide moieties, is well suited as a lubricant in conventional warm-pressing applications. The presence of monoamides allows the lubricant to act as a liquid lubricant at the pressing conditions, while the diamide and higher melting species act as both liquid and solid lubricants at these conditions.

As a whole, the amide lubricant begins to melt at a temperature between about 150° C. (300° F.) and 260° C. (500° F.), preferably about 200° C. (400° F.) to about 260° C. (500° F.). The amide product will generally be fully melted at a temperature about 250 degrees Centigrade above this initial melting temperature, although it is preferred that the amide reaction product melt over a range of no more than about 100 degrees Centigrade.

A preferred amide reaction product mixture has an acid value of from about 2.5 to about 5; a total amine value of from about 5 to 15, a density of about 1.02 at 25° C., a flash point of about 285° C. (545° F.), and is insoluble in water.

Amide lubricants are commercially available from Morton International of Cincinnati, Ohio as ADVAWAX7 450 or PROMOLD 450, which are each ethylene bis-stearamides having an initial melting point between about 200° C. and 300° C. Other ethylene bis-stearamide containing lubricants are available under the tradename KENOLUBE from Höganäs Corporation, located in Höganäs, AG Sweden. The KENOLUBE lubricant is a polymer material containing a mixture of ethylene bisstearamide and zinc stearate.

The amide lubricant will generally be added to the composition in the form of solid particles. The particle size of the lubricant can vary, but is preferably below about 100 microns. Most preferably the lubricant particles have a weight average particle size of about 5-50 microns.

Particulate internal lubricants are admixed with the metal-based powder in an amount up to about 3 percent by weight of the metallurgical powder composition. Preferably the metallurgical powder composition is composed of from about 0.1 to about 2 weight percent, more preferably about 0.1-1.0 weight percent, and even more preferably about 0.2-0.5 weight percent, of particulate internal lubricant. Even more preferably the metallurgical powder composition is composed of from about 0.2 to about 0.4 weight percent of particulate internal lubricant.

The metallurgical powder composition may also optionally contain one or more binding agents, particularly where an additional, separate alloying powder is used, to bond the different components present in the metallurgical powder composition so as to inhibit segregation and to reduce dusting. By "bond" as used herein, it is meant any physical or chemical method that facilitates adhesion of the components of the metallurgical powder composition.

In one embodiment, bonding is carried out through the use of at least one binding agent. Binding agents that can be used in the present invention are those commonly employed by the powder metallurgy industry. For example, such binding agents include those found in U.S. Pat. No. 4,834,800 to Semel, U.S. Pat. No. 4,483,905 to Engstrom, U.S. Pat. No. 5,298,055 to Semel et. al., and U.S. Pat. No. 5,368,630 to Luk, the disclosures of which are each hereby incorporated by reference in their entireties.

Binding agents include, for example, polyglycols such as polyethylene glycol or polypropylene glycol; glycerine; polyvinyl alcohol; homopolymers or copolymers of vinyl acetate; cellulosic ester or ether resins; methacrylate polymers or copolymers; alkyd resins; polyurethane resins; polyester resins; or combinations thereof. Other examples of binding agents that are useful are the relatively high molecular weight polyalkylene oxide-based compositions, e.g., the binders described in U.S. Pat. No. 5,298,055 to Semel et al.

Useful binding agents also include the dibasic organic acid, such as azelaic acid, and one or more polar components such as polyethers (liquid or solid) and acrylic resins as disclosed in U.S. Pat. No. 5,290,336 to Luk, which is incorporated herein by reference in its entirety. The binding agents in the '336 patent to Luk can also act advantageously as a combination of binder and lubricant. Additional useful binding agents include the cellulose ester resins, hydroxy alkylcellulose resins, and thermoplastic phenolic resins, e.g., the binders described in U.S. Pat. No. 5,368,630 to Luk.

The binding agent can further be the low melting, solid polymers or waxes, e.g., a polymer or wax having a softening temperature of below 200° C. (390° F.), such as polyesters, polyethylenes, epoxies, urethanes, paraffins, ethylene bis-stearamides, and cotton seed waxes, and also polyolefins with weight average molecular weights below 3,000, and hydrogenated vegetable oils that are $C_{14-24}$ alkyl moiety triglycerides and derivatives thereof, including hydrogenated derivatives, e.g. cottonseed oil, soybean oil, jojoba oil, and blends thereof, as described in WO 99/20689, published Apr. 29, 1999, which is hereby incorporated by reference in its entirety herein. These binding agents can be applied by the dry bonding techniques discussed in that application and in the general amounts set forth above for binding agents. Further binding agents that can be used in the present invention are polyvinyl pyrrolidone as disclosed in U.S. Pat. No. 5,069,714, which is incorporated herein in its entirety by reference, or tall oil esters.

The amount of binding agent present in the metallurgical powder composition depends on such factors as the density, particle size distribution and amounts of the iron-alloy powder, the iron powder and optional alloying powder in the metallurgical powder composition. Generally, the binding agent will be added in an amount of at least about 0.005 weight percent, more preferably from about 0.005 weight percent to about 1.0 weight percent, and most preferably from about 0.05 weight percent to about 0.5 weight percent, based on the total weight of the metallurgical powder composition.

Metallurgical powder compositions are easily removed from compaction dies while still having low organic material content, e.g., lubricant and binders. Metallurgical powder compositions generally include from about 0.01 to about 2.0 weight percent, preferably 0.01 to 1.0 weight percent of total organic material. Preferably, metallurgical powder composition include from about 0.1 to about 0.5 weight percent, and more preferably from about 0.2 to about 0.5 weight percent total organic material. Even more preferably, metallurgical powder composition include about 0.4 weight percent total organic material.

In one embodiment, a metallurgical powder composition is composed of a base metal powder and a particulate internal lubricant containing an amide lubricant. Preferably, metallurgical powder composition is composed of 0.40 weight percent of a particulate internal lubricant. Preferably, the amide-containing lubricant is composed of ethylene bis-stearamide having an initial melting point between about 200° C. and 300° C. More preferably, the amide-containing lubricant is composed of about 0.20 weight percent of a polyamide lubricant composed of ethylene bis-stearamides having an initial melting point between about 200° C. and 300° C., e.g., Promold 450, and about 0.20 weight percent of a polyamide lubricant composed of an ethylene bisstearamide and zinc stearate admixture, e.g., Kenolube.

In another embodiment, a metallurgical powder composition is composed of a base metal powder bonded with a particulate internal lubricant containing an amide lubricant. Preferably, the metallurgical powder composition is composed of 0.40 weight percent total organic content. The organics materials include 0.10 weight percent binding agent and 0.30 weight percent internal lubricant containing an amide lubricant. Preferably, the amide-containing lubricant is composed of ethylene bis-stearamide having an initial melting point between about 200° C. and 300° C. More preferably, the amide-containing lubricant is composed of about 0.15 weight percent of a polyamide lubricant composed of ethylene bis-stearamides having an initial melting point between about 200° C. and 300° C., e.g., Promold 450, and about 0.15 weight percent of a polyamide lubricant composed of an ethylene bisstearamide and zinc stearate admixture, e.g., Kenolube. Preferably, the binding agent among those found in U.S. Pat. No. 5,298,055 to Semel et. al.

Compacted articles prepared from metallurgical powder compositions have high density. Preferably, compacted articles have a density of at least about 6.6 g/cm$^3$. More preferably, compacted articles exhibit a density of at least about 7.2 g/cm$^3$. More preferably compacted articles exhibit a density of from about 7.25 g/cm$^3$ to about 7.7 g/cm$^3$. Even more preferably, compacted articles exhibit a density of from about 7.35 g/cm$^3$ to about 7.6 g/cm$^3$. Still more preferably, compacted articles exhibit a density of from about 7.4 g/cm$^3$ to about 7.6 g/cm$^3$. More preferably, the compacted articles exhibit a density greater than 7.45 g/cm$^3$.

Methods for preparing metallurgical powder compositions are "one step" methods or "multi step" methods. A "one step" method includes of a first step of admixing a base metal powder, metal phosphate, a particulate internal lubricant, and optional alloying powders, and additives that will form the metallurgical powder composition. Generally, the base-metal powder, optional alloying powder, and particulate internal lubricant (along with any other conventional additive) are admixed, preferably in dry form, by conventional mixing techniques, such as the use of a double cone blender, to form a substantially homogeneous particle blend. The admixture is then combined with protonic acid to react and form a metal phosphate coating on the component powders. In one embodiment, the metal phosphate layer is formed at the same time that the particles are being bonded together with a binding agent. The "one step" process saves time and related expense in manufacturing processes, especially large scale processes for fabricating commercial quantities of metallurgical powder compositions.

A"multi step" method includes forming a metal phosphate coating on a metal based powder prior to admixing with a particulate internal lubricant and optional additives that will form the metallurgical powder composition. First, a base-metal powders, optionally alloying powders, or combination of both, are admixed with a metal phosphate. The admixture is then combined with a protonic acid to react to form a metal phosphate coating on the admixture of powders. The coated admixture is then combined with a particulate internal lubricant and any additional optional alloying powders or additives, e.g., binders. Generally, the "multi step" process provides a greater increase in lubricity and green strength over conventional techniques compared to the "one step" process.

Protonic acids are any substance that can donate a hydrogen ion (proton). Exemplary protonic acids include, for example, but are not limited to, hydrochloric acid, nitric acid, sulfuric acid, acetic acid, phosphoric acid, and water. Preferably, the protonic acid is phosphoric acid, hydrochloric acid, sulfuric acid, or nitric acid. More preferably, the protonic acid is phosphoric acid.

Optionally, the protonic acid may be diluted in a solvent prior to being combined with the admixture of base-metal powder and metal phosphate. Typical solvents include, for example, acetone, ethyl acetate, water, diethyl ether, dichloromethane, methanol, ethanol, and toluene. Preferably, the solvent is acetone. The solvent is removed from the admixture via conventional drying techniques, such as for example, vacuum techniques, heating the admixture to from about 100° F. to about 150° F., or combinations thereof.

Optionally, the base-metal powder and metal phosphate are heated prior to addition of the protonic acid. The admixture of base-metal powder and metal phosphate is heated to at least about 100° F., more preferably, from about 100° F. to about 125° F., and even more preferably at about 110° F.

Optionally, after the protonic acid and metal phosphate have reacted with the base metal powder, the protonic acid is not removed so that the metallurgical powder compositions may include a small amount of excess protonic acid, such as for example from about 0.001 to about 0.2 weight percent of protonic acid.

In some embodiments, metallurgical powder compositions are prepared by first admixing and bonding a base metal powder, metal phosphate, optional alloying powders, and a polyamide lubricant composed of ethylene bis-stearamides having an initial melting point between about 200° C. and 300° C., e.g., Promold 450, and a lithium stearate or a polyamide lubricant composed of an ethylene bisstearamide and zinc stearate admixture, e.g., Kenolube. The composition is then reacted with phosphoric acid until completion and the metallurgical powder composition is dried, preferably in air. The composition is then admixed with additional lithium stearate or Kenolube.

Methods of prepared compacted articles include a first step of providing a metallurgical powder composition. The metallurgical powder composition is placed in a compaction die cavity and compacted under pressure, such as between about 5 and about 200 tons per square inch (tsi), more commonly between about 10 and 100 tsi, and even more commonly between about 30 and 60 tsi. The compacted part is then ejected from the die cavity. The die may optionally be cooled below room temperature or heated above room temperature. The die may be heated to greater than about 100° F. Preferably the die is heated to greater than about 120° F. More preferably, the die is heated to as much as 270° F., such as for example from about 150° F. to about 500° F.

Optionally, an external lubricant can be applied to the die wall. External lubricants include graphite, boron nitride, and ethylene bisteramide, including high temperature variants of the same. Preferably the external lubricant is boron nitride.

The amount of external lubricant applied to a die wall is typically from about 0.0 to about 2.0 weight percent, preferably 0.01 to 0.5 weight percent of the metallurgical powder composition. Preferably, from about 0.01 to about 0.25 weight percent, and more preferably from 0.01 to about 0.15 weight percent particulate internal lubricant is applied to the die wall. Generally, when metallurgical powder compositions include at least 0.4 weight percent particulate internal lubricant, an external lubricant is not use. In some embodiments, however, an external lubricant is used when preparing compacts with metallurgical powder compositions composed of at least 0.4 weight percent particulate internal lubricant.

The compacted ("green") part may be optionally sintered to enhance its strength. The compacted part is sintered using conventional sintering techniques known to those skilled in the art. Sintering is conducted for a time and at a temperature sufficient to achieve metallurgical bonding and alloying. Additional processes such as forging or other appropriate manufacturing technique or secondary operation may be used to produce a finished part.

Sintering is advantageously conducted at a temperature of at least 2050° F. (1120° C.), preferably at least 2150° F. (1175° C.), more preferably at least about 2200° F. (1200° C.), more preferably at least about 2250° F. (1230° C.), and even more preferably at least about 2300° F. (1260° C.).

Those skilled in the art will appreciate that numerous changes and modifications may be made to the preferred embodiments of the invention and that such changes and modifications may be made without departing from the spirit of the invention. The following examples further describe the metallurgical powder compositions.

EXAMPLES

Some embodiments of the present invention will be described in detail in the following Examples. Base-metal powder composition were prepared and formed into compacted parts in accordance with the methods described above. The compacted parts were evaluated for green and sintered properties. The forces necessary to remove the compacted parts from a compacting die were also evaluated. Lastly, the bonding properties of zinc phosphate were analyzed.

Example 1

Metallurgical powder compositions were prepared to analyze green and sintered properties. Composition 1 was prepared by combining a prealloyed iron based powder composed of 0.85 weight percent molybdenum and balance iron, 0.1 weight percent zinc phosphate, 0.1 weight percent phosphoric acid, 2.0 weight percent nickel, 0.6 weight percent graphite, and 0.5 weight percent particulate internal lubricant. The prealloyed iron based powders in Compositions 1 & 2 are commercially available as Ancorsteel A85HP from Hoeganaes Corp. in Cinnaminson, N.J. The particulate internal lubricants in Compositions 1 & 2 are commercially available as Acrawax from Glycol Chemical Co.

Composition 2 was prepared by combining a prealloyed iron based powder composed of 0.85 weight percent molybdenum and balance iron, 2.0 weight percent nickel, 0.6 weight percent graphite, and 0.6 weight percent particulate internal lubricant.

Compositions 1 & 2 were compacted at 50 tons per square inch (tsi) to form test bars. Green properties of the test bars were evaluated. Green density was evaluated using ASTM B331-95 test methodology. Green strength was evaluating using ASTM B312-96 test methodology. Green expansion was determined according to the following equation:

$$\text{Green Expansion (\%)} = \frac{100[(\text{Green bar length}) - (\text{Die length})]}{\text{Die length}}$$

The results are reported below in Table 1:

TABLE 1

| Sample | Compaction Temp. (° F.) | Green Density (g/cm$^3$) | Green Strength (psi) | Green Expansion (%) |
|---|---|---|---|---|
| Composition 1 | Room Temp. | 7.19 | 2144 | 0.28 |
| Composition 2 | Room Temp. | 7.19 | 2271 | 0.28 |
| Composition 1 | 145 | 7.24 | 4270 | 0.23 |
| Composition 2 | 145 | 7.24 | 2620 | 0.25 |
| Composition 1 | 200 | 7.31 | 6547 | 0.20 |
| Composition 2 | 200 | 7.30 | 2777 | 0.24 |
| Composition 1 | 270 | 7.39 | 6614 | 0.21 |
| Composition 2 | 270 | 7.38 | 3050 | 0.24 |

Green compacts made from metallurgical powder compositions containing a metal phosphate coating exhibited improved compressibility, higher green strength, and lower green expansion compared to green compacts made from compositions that did not include a metal phosphate coating. As shown in Table 1, the green strength of composition 1 was higher than the green strength of composition 2 at compaction temperatures greater than 120° F. Similarly, the green expansion of composition 1 was lower than the green expansion of composition 2.

The ejection forces necessary to remove the compacted part from the die were analyzed. Strip pressure measures the static friction that must be overcome to initiate ejection of a compacted part from a die. It was calculated as the quotient of the load needed to start the ejection over the cross-sectional area of the part that is in contact with the die surface, and is reported in units of psi. Slide pressure is a measure of the kinetic friction that must be overcome to continue the ejection of the part from the die cavity; it is calculated as the quotient of the average load observed as the part traverses the distance from the point of compaction to the mouth of the die, divided by the surface area of the part, and is reported in units of psi. The results are reported below in Table 2:

TABLE 2

| Sample | Compaction Temp. (° F.) | Green Density ($g/cm^3$) | Strip (psi) | Slide (psi) |
|---|---|---|---|---|
| Composition 1 | Room Temp. | 7.19 | 3315 | 2171 |
| Composition 2 | Room Temp. | 7.19 | 4191 | 2432 |
| Composition 1 | 145 | 7.24 | 4023 | 2093 |
| Composition 2 | 145 | 7.24 | 4523 | 2425 |
| Composition 1 | 200 | 7.31 | 3891 | 2012 |
| Composition 2 | 200 | 7.30 | 4382 | 2452 |
| Composition 1 | 270 | 7.39 | 3087 | 2213 |
| Composition 2 | 270 | 7.38 | 2833 | 1804 |

At low compaction temperature green compacts made from metallurgical powder compositions containing a metal phosphate coating were removed from the die by lower ejection forces compared to the ejection forces required to remove green compacts prepared from compositions that did not include a metal phosphate coating. As shown in Table 2, at compaction temperatures below 270° F., composition 1 required lower ejection forces to remove the green compact from a die compared the ejection forces required to remove a compact prepared from composition 2.

The compacted parts were sintered at 2050° F. for about 20 minutes. Sintered properties of the test bars were evaluated. The results are reported below in Table 3:

TABLE 3

| Sample | Compaction Temp. (° F.) | Sintered Density ($g/cm^3$) | DC (%) | TRS (ksi) | Hardness (Hra) |
|---|---|---|---|---|---|
| Composition 1 | Room Temp. | 7.21 | 0.18 | 191 | 56.9 |
| Composition 2 | Room Temp. | 7.21 | 0.13 | 193 | 56.3 |
| Composition 1 | 145 | 7.25 | 0.18 | 196 | 57.0 |
| Composition 2 | 145 | 7.25 | 0.15 | 203 | 56.5 |
| Composition 1 | 200 | 7.29 | 0.18 | 202 | 56.8 |
| Composition 2 | 200 | 7.30 | 0.16 | 211 | 57.6 |
| Composition 1 | 270 | 7.36 | 0.18 | 217 | 57.9 |
| Composition 2 | 270 | 7.35 | 0.19 | 224 | 58.0 |

Example 2

Pilot scale production powder blends were prepared to analyze the bonding properties of metallurgical powder compositions. Composition 3 was prepared by combining a substantially pure iron powder, an Fe—Cr—Si masteralloy powder, graphite, and a particulate internal lubricant. The blend of substantially pure iron powder and Fe—Cr—Si masteralloy powder is commercially available as A4300 from Hoeganaes Corp. The Fe—Cr—Si masteralloy powder was of the type described in U.S. patent application Ser. No. 10/818,782, which is herein incorporated by reference in its entirety. The blended metallurgical powder composition was composed of 1.0 weight percent chromium, 1.0 weight percent nickel, 0.8 weight percent molybdenum, 0.6 weight percent silicon, 0.1 weight percent manganese, 0.6 weight percent graphite, and 0.75 weight percent particulate internal lubricant (Acrawax). Composition 3 did not contain zinc phosphate coated powders.

Composition 4 was prepared using the bonding process described in U.S. Pat. No. 5,290,336. This metallurgical powder composition was composed of 0.55 weight percent of particulate internal lubricant (Acrawax). This composition illustrates the retention characteristics imparted to powder compositions that have been bonded using conventional bonding techniques.

Composition 5 was prepared by combining a prealloyed iron based powder, an Fe–Cr—Si masteralloy powder, a nickel powder, graphite, and a particulate internal lubricant. The prealloyed iron based powder was composed of 0.85 weight percent molybdenum and balance iron, which is commercially available as Ancorsteel A85HP from Hoeganaes Corp. The prealloyed iron based powder was coated with 0.1 weight percent zinc phosphate. The Fe—Cr—Si masteralloy powder was of the type used in Composition 3. The blended metallurgical powder composition was composed of 1.0 weight percent chromium, 1.0 weight percent nickel, 0.8 weight percent molybdenum, 0.6 weight percent silicon, and 0.4 weight percent particulate internal lubricant (Acrawax).

Composition 6 was prepared by combining the components of Composition 5, except that each of the prealloyed iron based powder, the Fe—Cr—Si masteralloy powder, and the nickel powder was coated with 0.1 weight percent zinc phosphate, based on the weight of the metallurgical powder composition.

Composition 7 was prepared by combining a prealloyed iron based powder, an Fe—Cr—Si masteralloy powder, a nickel powder, graphite, a particulate internal lubricant, and an external lubricant. The prealloyed iron based powder, the Fe—Cr—Si masteralloy powder, and the nickel powder were each coated with 0.1 weight percent of zinc phosphate, based on the weight of the metallurgical powder composition. Composition 7 was bonded by using conventional bonding techniques described in U.S. Pat. No. 5,290,336. The blended metallurgical powder composition was composed of 1.0 weight percent chromium, 1.0 weight percent nickel, 0.8 weight percent molybdenum, 0.6 weight percent silicon, 0.2 weight percent particulate internal lubricant (Acrawax), and 0.2 weight percent of an external lubricant.

Bonding properties were analyzed by examining the composition's susceptibility to "dusting" effects. "Retention" is defined as the amount of fine powder additives retained within the powder mass after it is subjected to a pulsating air pressure. Retention is measured by subjecting a fixed amount of powder to a pulsating stream of air pressure in an open top vessel. The pulsating air pressure will cause both fine metal powders and low-density additives, such as for example graphite and lubricant, to separate from the powder mass and float out of the containing vessel according to Stokes Law. The amount of fine powder or low-density additive remaining in the powder is measured by collecting the separated powder, weighing, and then determining the amount retained. The retention data for compositions 3-7 is described in Table 4:

TABLE 4

| Sample | Phosphate Coating | Bonded | Retention: Master Alloy Powder | Retention: Nickel Powder |
|---|---|---|---|---|
| Composition 3 | No | No | 31% | 24% |
| Composition 4 | No | Yes | 80% | 67% |
| Composition 5 | Only Iron Prealloy Powder | No | 37% | 24% |

TABLE 4-continued

| Sample | Phosphate Coating | Bonded | Retention: Master Alloy Powder | Retention: Nickel Powder |
|---|---|---|---|---|
| Composition 6 | Iron Prealloy Powder, Master Alloy Powder, Nickel Powder | No | 76% | 68% |
| Composition 7 | Iron Prealloy Powder, Master Alloy Powder, Nickel Powder | Yes | 90% | 87% |

As shown in Table 4, a non-bonded material will retain about 31% of the master alloy and 24% of the fine nickel additive. Conventional bonding processes increases these amounts to 80% and 67% respectively. Phosphate treating the iron powder and then adding the master alloy and nickel and premix additives does not substantially increase the amount of alloy retained. However, adding the master alloy and nickel and then phosphate coating the iron powder results in a significant increase in the amount of additives retained within the powder mass, similar to what is achieved with conventional bonding processes. If this same material is then subjected to an conventional bonding processes, the amount of powder retained exceeds what can be achieved by the conventional bonding process or metal phosphate treatment alone.

Example 3

Pilot scale production powder blends were prepared to analyze the physical properties of metallurgical powder compositions. Composition 8 was a metallurgical powder composition prepared by combining a prealloyed iron powder with nickel powder, graphite, and particulate internal lubricant. The metallurgical powder composition included 0.85 molybdenum, 2.0 weight percent nickel, 0.4 weight percent graphite, 0.1 weight percent zinc phosphate, and 0.4 weight percent lithium stearate particulate internal lubricant. The prealloyed iron based powder was composed of 0.85 weight percent molybdenum and balance iron (Ancorsteel A85HP). The particulate internal lubricant was commercially available from Lonza Corp. in New Jersey.

Composition 8 was compacted into test bars on a conventional mechanical compacting press at 150° F. and 53 tons per square inch. The test bars exhibited a green density of 7.4 g/cm$^3$. The green compact was then sintered at 2050° F. for about 20 minutes. The sintered compact exhibited a density of 7.47 g/cm$^3$.

Composition 8 was compared to a conventional metallurgical powder compositions composed of 0.55% total organic material. This composition is commercially available as AncorMaxD from Hoeganaes Corp. Both powders were compacted at 50 tsi and die temperatures greater than 150 F. The conventional composition exhibited a green density of about 7.30 to 7.35 g/cm$^3$. Composition 8 utilizes only 0.40% total organic content and exhibited a green density of about 7.37 to 7.42 g/cm$^3$.

Composition 9 was a metallurgical powder composition prepared by combining a diffusion bonded powder coated with zinc phosphate, graphite, and an particulate internal lubricant. The diffusion bonded powder was composed of about 4.05% nickel, about 0.55% molybdenum, and about 1.6% copper. The diffusion bonded powder is commercially available as DISTALOY 4800A from Hoeganaes Corporation. Composition 9 was composed of 0.4 weight percent graphite, 0.1 weight percent zinc phosphate, and 0.2 weight percent particulate internal lubricant. The particulate internal lubricant is produced by Hoeganaes Corporation of Riverton, N.J. as Promold™ 450.

Composition 9 was compacted into test bars on a conventional mechanical compacting press at 450° F. and 50 tons per square inch. The test bars exhibited a green density of ~7.45 g/cm$^3$ and a sintered density of ~7.5 g/cm$^3$. This composition exhibited green strengths in excess of 11,000 psi. Moreover, sintered mechanical properties were unaffected by the addition of zinc phosphate.

Example 4

Compacted parts were prepared to examine the ejection forces required to remove the parts from a die. Composition 10 was a metallurgical powder composition prepared by bonding a prealloyed iron based powder with an graphite and an internal lubricant containing an amide lubricant. The prealloyed iron based powder was composed of 0.85 weight percent molybdenum and balance iron that was combined with 0.1 weight percent zinc phosphate, 0.1 weight percent phosphoric acid, 0.6 weight percent graphite, and 0.4 weight percent total organic content. The prealloyed iron based powder is commercially available as Ancorsteel A85HP from Hoeganaes Corp. in Cinnaminson, N.J. The organic materials included 0.10 weight percent binding agent and 0.30 weight percent particulate internal lubricant containing an amide lubricant. The particulate internal lubricant was composed of about 0.15 weight percent of a polyamide lubricant commercially available as KENOLUBE from Höganäs Corporation, located in Höganäs, AG Sweden, and about 0.15 weight percent of a polyamide lubricant commercially available as PROMOLD 450 from Morton International of Cincinnati, Ohio.

Composition 11 was a metallurgical powder composition prepared by admixing a prealloyed iron based powder with 0.6 weight percent graphite and 0.4 weight percent particulate internal lubricant. The prealloyed iron based powder was composed of 0.85 weight percent molybdenum and balance iron. The particulate internal lubricant was commercially available as Acrawax from Glycol Chemical Co.

Composition 12 was a metallurgical powder composition prepared in the same manner as Composition 11, except that the 0.4 weight percent particulate internal lubricant was replaced with 0.75 weight percent of Acrawax particulate lubricant.

Compositions 10, 11, and 12 were compacted at 30, 40, 50, and 60 tons per square inch (tsi) to form test bars measuring one inch tall and 0.56 inches in diameter. Ejection properties of the test bars were evaluated.

Figure 2:
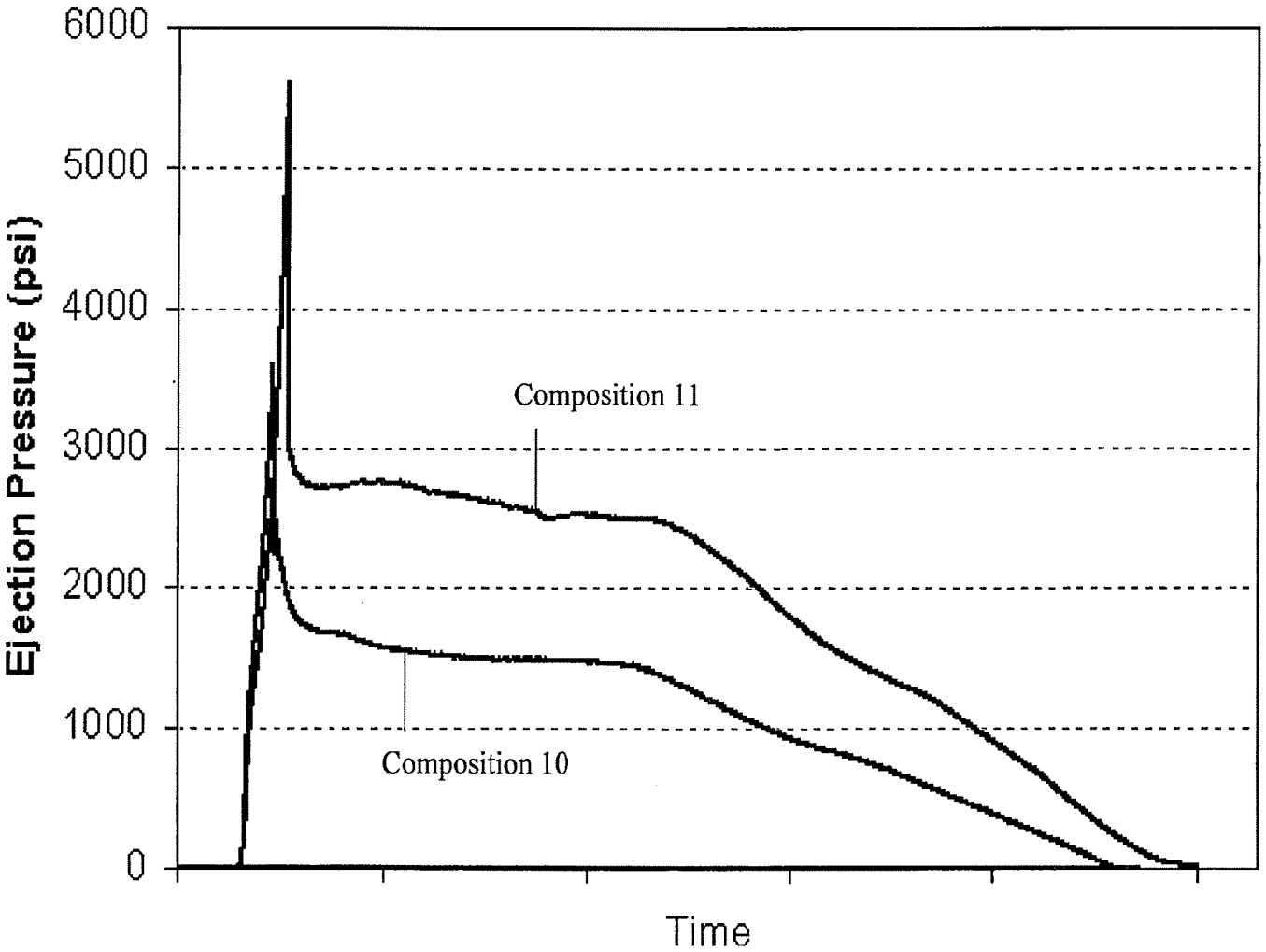
FIG. 2 is a graph of ejection pressure verses time comparing compacts prepared from an exemplary metallurgical powder composition and compacts prepared from a conventional metallurgical powder composition.
Figure 3:
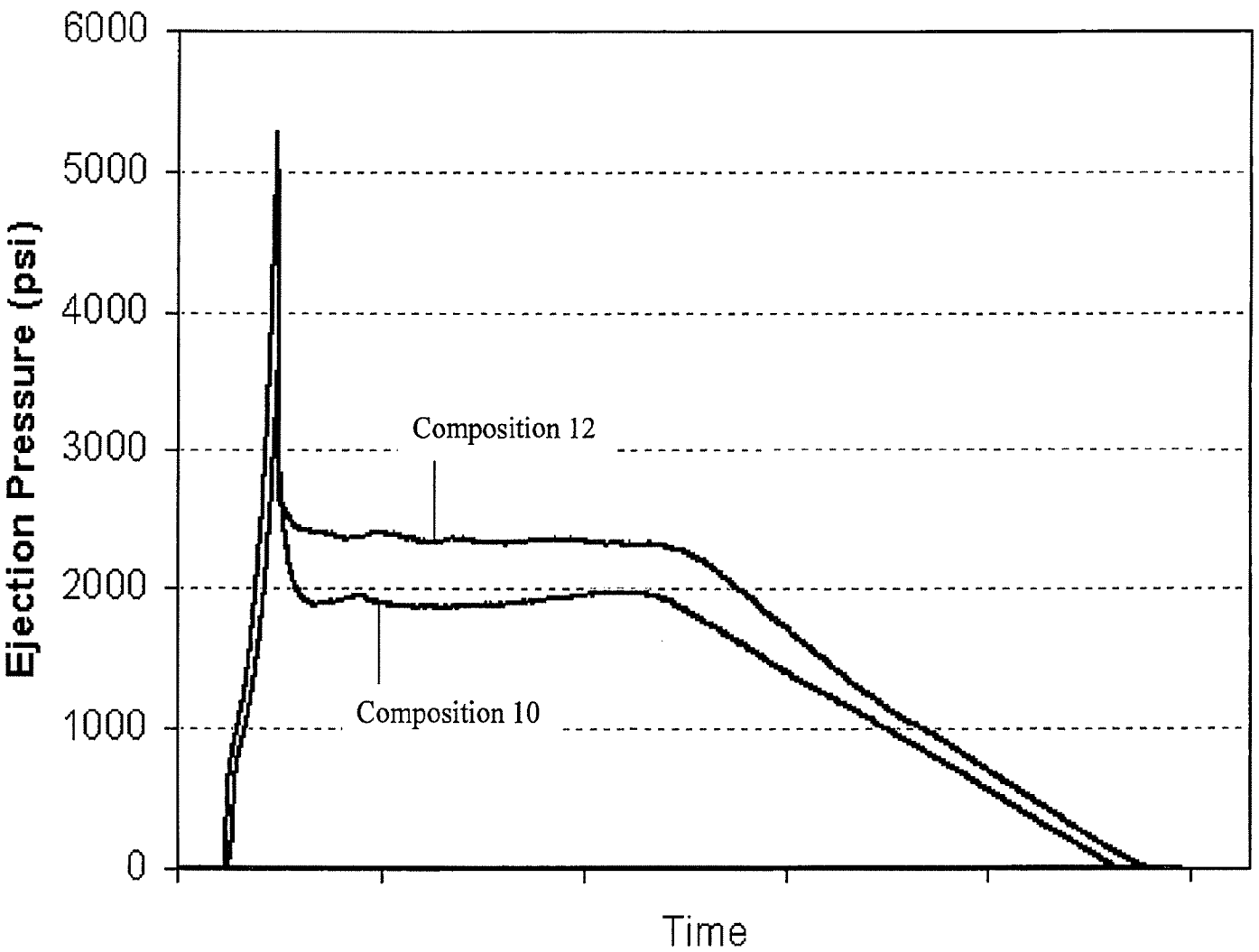
FIG. 3 is another graph of ejection pressure verses time comparing compacts prepared from an exemplary metallurgical powder composition and compacts prepared from a conventional metallurgical powder composition.

FIG. 1 is a graph of ejection pressure verses time for test bars prepared from composition 10. FIGS. 2 and 3 are graphs of ejection pressure verses time comparing test bars prepared from compositions 10, 11, and 12. Test bars prepared from compositions 11 and 12 were heavily scored at 40 tsi and could not be produced when compressed at 50 and 60 tsi. Referring to FIGS. 1 and 2, bars prepared from composition 10 required lower strip and slide forces for removal from a die compared with bars prepared from compositions 11 and 12. Thus, it was easier to remove bars prepared from composition 10 compared to bar prepared from compositions 11 and 12.

One method of evaluating compacted parts is to compare the ratio of die surface area to planer area, i.e. M/Q ratio. Shown below in table 5 are calculated M/Q ratios for various die configurations:

TABLE 5

| Height (Inches) | Cincy bushing 1.5 OD, 1.0 ID (core rod surface rea included) | HC Gear 16 teeth | Cincy bushing 1.5 OD, 1.0 ID (core rod surface area excluded) | HC Gear 16 teeth | GS Bar 0.5" × 1.25" (core rod not applicable) | ToniTek Slug 0.55" diameter |
|---|---|---|---|---|---|---|
| 0.250 | 2.0 | 3.0 | 1.2 | 2.5 | 1.4 | 1.8 |
| 0.375 | 3.0 | 4.5 | 1.8 | 3.8 | 2.1 | 2.7 |
| 0.500 | 4.0 | 6.0 | 2.4 | 5.1 | 2.8 | 3.6 |
| 0.625 | 5.0 | 7.5 | 3.0 | 6.4 | 3.5 | 4.5 |
| 0.750 | 6.0 | 9.0 | 3.6 | 7.6 | 4.2 | 5.5 |
| 0.875 | 7.0 | 10.5 | 4.2 | 8.9 | 4.9 | 6.4 |
| 1.000 | 8.0 | 12.0 | 4.8 | 10.2 | 5.6 | 7.3 |
| 1.125 | 9.0 | 13.5 | 5.4 | 11.5 | 6.3 | 8.2 |
| 1.250 | 10.0 | 15.0 | 6.0 | 12.7 | 7.0 | 9.1 |
| 1.375 | 11.0 | 16.5 | 6.6 | 14.0 | 7.7 | 10.0 |
| 1.500 | 12.0 | 18.0 | 7.2 | 15.3 | 8.4 | 10.9 |
| 1.625 | 13.0 | 19.5 | 7.8 | 16.5 | 9.1 | 11.8 |
| 1.750 | 14.0 | 21.0 | 8.4 | 17.8 | 9.8 | 12.7 |
| 1.875 | 15.0 | 22.5 | 9.0 | 19.1 | 10.5 | 13.6 |
| 2.000 | 16.0 | 24.0 | 9.6 | 20.4 | 11.2 | 14.5 |

M/Q ratios were useful for comparing the ejection properties of known geometric slugs and more complex parts. Generally, ejection forces required to remove parts from a die were similar between parts having similar M/Q values. For example with reference to Table 5, the ejection force required to remove a 0.55" diameter Tonitec slug having a height of 1.0" (M/Q=7.3) from a die was similar to the ejection force needed to remove a 16 tooth HC gear of 0.625 inch height for example (M/Q=7.5).

What is claimed is:

1. A metallurgical powder composition comprising:

0.2-0.5 weight percent, based on the metallurgical powder composition, of an internal lubricant comprising lithium stearate; and, at least 85 weight percent, based on the metallurgical powder composition, of an iron-based powder, wherein the particles of the iron-based powder are at least partially coated with a lubricating coating comprising:

about 0.1 weight percent, based on the weight of the iron-based powder, of zinc phosphate; and 0.1 weight percent, based on the weight of the iron-based powder, of phosphoric acid.

2. The metallurgical powder composition of claim 1, further comprising:

about 0.10 weight percent of a binding agent.

3. The metallurgical powder composition of claim 1, wherein the iron-based powder further comprises an alloying powder.

4. The metallurgical powder composition of claim 1, further comprising 2.0 weight percent of nickel, based on the weight of the metallurgical powder composition.

5. The metallurgical powder composition of claim 1, further comprising 0.4 weight percent of graphite, based on the weight of the metallurgical powder composition.

6. The metallurgical powder composition of claim 1, further comprising 2.0 weight percent of nickel, based on the weight of the metallurgical powder composition; and 0.4 weight percent of graphite, based on the weight of the metallurgical powder composition.

7. The metallurgical powder composition of claim 1, further comprising about 0.2 weight percent, based on the metallurgical powder composition, lithium stearate.

8. The metallurgical powder composition of claim 1, further comprising 2.0 weight percent of nickel, based on the metallurgical powder composition; 0.4 weight percent of graphite, based on the metallurgical powder composition; and about 0.2 weight percent, based on the metallurgical powder composition, of lithium stearate.

* * * * *